US006545237B1

(12) United States Patent
Passow et al.

(10) Patent No.: US 6,545,237 B1
(45) Date of Patent: Apr. 8, 2003

(54) SYSTEM AND METHOD FOR MOUNTING A MOVEABLE CONTACT IN A CONTACT BLOCK

(75) Inventors: Christian H. Passow, Ann Arbor, MI (US); Kevin B. Tews, North Aurora, IL (US)

(73) Assignee: Siemens Energy & Automation, Alpharetta, GA (US)

( * ) Notice: Subject to any disclaimer, the term of this patent is extended or adjusted under 35 U.S.C. 154(b) by 0 days.

(21) Appl. No.: 09/961,156

(22) Filed: Sep. 21, 2001

(51) Int. Cl.[7] ..... H01H 1/20

(52) U.S. Cl. ..... 200/243

(58) Field of Search ..... 200/243, 275, 200/281, 452, 447, 245

(56) References Cited

U.S. PATENT DOCUMENTS 6,180,899 B1 * 1/2001 Passow ..... 200/243

* cited by examiner

*Primary Examiner*—Elvin Enad
*Assistant Examiner*—M. Fishman

(57) ABSTRACT

A contact assembly for use in an electrical apparatus includes an armature comprising a base and a post having first and second ends. The first end is connected to the base and the second end comprises intersecting cross members defining four quadrants and a body extending between the cross members in one of the four quadrants. A moveable contact is received on the post. The moveable contact comprises an elongate bar having contact pads at opposite ends of one face and a central opening. The central opening comprises intersecting slots defining four quadrants and a void extending between the slots in one of the four quadrants. The central opening is slightly larger than the post second end so that the moveable contact is mounted to the post with the contact pads facing in a desired direction.

21 Claims, 5 Drawing Sheets

SYSTEM AND METHOD FOR MOUNTING A MOVEABLE CONTACT IN A CONTACT BLOCK

CROSS-REFERENCE TO RELATED PATENT APPLICATIONS

The present U.S. patent application having at least one common inventor as:

- U.S. patent application Ser. No. 10/252,633 entitled "System and Method for Auxiliary Contact Assembly", and
- U.S. patent application Ser. No. 09/961,159 entitled "System and Method for Auxiliary Contact Assembly and Snap Mounting", and
- U.S. patent application Ser. No. 09/961,162 entitled "System and Method for Mounting a Pusher and Moveable Contact in a Contact Block", and
- U.S. patent application Ser. No. 09/961,158 entitled "Contact Block Assembly and Method of Assembling a Contact Block Assembly", and
- U.S. patent application Ser. No. 09/961,161 entitled "Pusher Assembly and Method for Assembling a Pusher Assembly",
- U.S. patent application Ser. No. 09/961,160 entitled "Movable Contact and a Method of Assembling a Pusher Assembly having a Movable Contact", are filed with the U.S. patent and Trademark Office concurrently on Sep. 21, 2001, the entirety of each being incorporated herein by reference.

TECHNICAL FIELD OF THE INVENTION

This invention relates to a contact assembly for use in an electrical switching apparatus designed to facilitate mounting of a moveable contact.

BACKGROUND OF THE INVENTION

A conventional electrical switching apparatus in one known form typically comprises an electromagnetically actuable device having a magnetic core proximate an armature. Typically, a coil is electrically energized to draw the armature to the magnetic core. The electromagnetically actuated device may be a control relay, a contactor, a motor starter or the like. The armature is operatively associated with a movable device such as an actuator. With an electrical switching apparatus the actuator operates a contact assembly.

A contact assembly may be an integral component of the electrical switching apparatus or it may an auxiliary device to be added thereto. In either case, a housing typically supports an electrical contact and a pusher. The pusher is selectively actuated to operate the electrical contact. A typical electrical contact includes one or two stationary contacts mounted in the housing and a moveable contact mounted on the pusher. The stationary contact and the moveable contact each typically include a metal bar carrying a contact pad on one side. The electrical contact is made when the contact pad of the moveable contact makes contact with the contact pad of the stationary contact. The electrical contact is broken when the contact pad of the moveable contact is spaced from the contact pad of the stationary contact.

A problem in manufacturing is that moveable contacts are mistakenly mounted in an inverted position on the pusher. When mounted in an inverted position the movable contact metal bar may make contact with the contact pad of the stationary contact to complete the circuit. However, due to the incorrect assembly, the useful life of the contact assembly is greatly reduced.

Unfortunately, a typical continuity test, in which the pusher is driven against its own internal stops, does not reveal if the moveable contact is mounted in an inverted position on the pusher.

Accordingly, there is a need for a contact assembly for use in an electrical switching apparatus designed to eliminate opportunity of incorrect assembly.

SUMMARY OF THE INVENTION

In accordance with the invention there is provided a contact assembly for use in an electrical switching apparatus designed to eliminate opportunity of incorrect assembly.

In accordance with one aspect of the invention there is disclosed a contact assembly for use in an electrical apparatus. An armature comprises a base and a post having first and second ends. The first end is connected to the base and the second end comprises intersecting cross members defining four quadrants and a body extending between the cross members in one of the four quadrants. A moveable contact is received on the post. The moveable contact comprises an elongate bar having contact pads at opposite ends of one face and a central opening. The central opening comprises intersecting slots defining four quadrants and a void extending between the slots in one of the four quadrants. The central opening is slightly larger than the post second end so that the moveable contact is mounted to the post with the contact pads facing in a desired direction.

It is a feature of the invention that one of the slots has a greater length than the other of the slots and one of the cross members has a greater length than the other of the cross members. The slot having the greater length extends longitudinally and the other of the slots extends transversely.

It is another feature of the invention that the base comprises an elongate base and in one aspect of the invention the cross member having the greater length extends longitudinally relative to the elongate base. The post includes a support below the second end to support the moveable contact longitudinally extending relative to the elongate base.

In another aspect of the invention the cross member having the greater length extends transversely relative to the elongate base. The post has a narrower section between the first and second ends and the moveable contact is mounted on the narrower section and extends longitudinally relative to the elongate base and the cross member having the greater length acts as a fulcrum for the moveable contact.

In accordance with yet another aspect of the invention there is disclosed a contact assembly for use in an electrical apparatus. An armature comprises a base and a post having first and second ends. The first end is connected to the base and the second end has an asymmetric head. A moveable contact is received on the post. The moveable contact comprises an elongate bar having contact pads at opposite ends of one face and a central opening. The central opening is asymmetric, similar in shape to the asymmetric head. The central opening is slightly larger than the asymmetric body so that the moveable contact is mounted to the post with the contact pads facing in a desired direction.

There is disclosed in accordance with a further aspect of the invention the method of mounting a moveable contact in a contact block comprising: providing an armature comprising a base, a post having first and second ends, the first end being connected to the base and the second end comprising intersecting cross members defining four quadrants and a body extending between the cross members in one of the four quadrants; mounting a moveable contact on the post, the moveable contact comprising an elongate bar having contact pads at opposite ends of one face and a central opening, the central opening comprising intersecting slots defining four quadrants and a void extending between the slots in one of the four quadrants, the central opening being slightly larger than the post second end so that the moveable contact is mounted to the post with the contact pads facing in a desired direction; and mounting the armature in a housing.

Further features and advantages of the invention will be readily apparent from the specification and from the drawings.

DETAILED DESCRIPTION OF THE INVENTION

Figure 1:
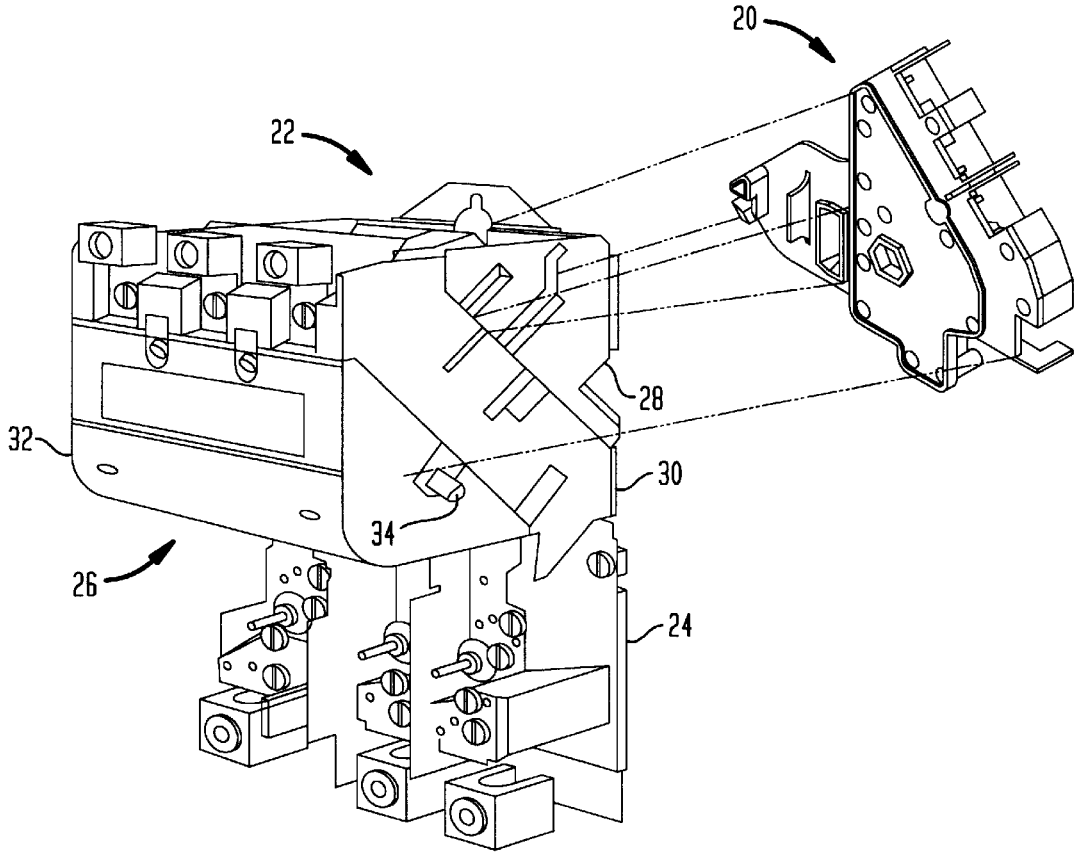
FIG. 1 is a perspective view illustrating a contact assembly used with an electrical switching apparatus in accordance with the invention.

Referring to FIG. 1, a contact assembly in the form of an auxiliary contact block 20 for use with an electrical switching apparatus in the form of an electrical contactor 22 is illustrated. The present invention relates to a contact assembly designed to eliminate opportunity of incorrect assembly.

The contactor 22 is an electromagnetically actuable device and includes a mounting plate 24 for mounting in a control panel or the like. A main housing 26 is mounted to the mounting plate 24. The main housing 26 includes a base 28, a switch housing 30 and a cover 32. Although not specifically illustrated herein, the main housing 26 encloses an electrical coil associated with a magnetic core and armature for driving an actuator having opposite ends 34, one of which is shown in FIG. 1. Additionally, the main housing 26 encloses various electrical contacts which can be opened or closed responsive to energization of the coil. The actuator ends 34 extend outwardly of opposite sides of the main housing 26. As a result, the auxiliary contact block 20 can be mounted to either side of the main housing 26.

Figure 2:
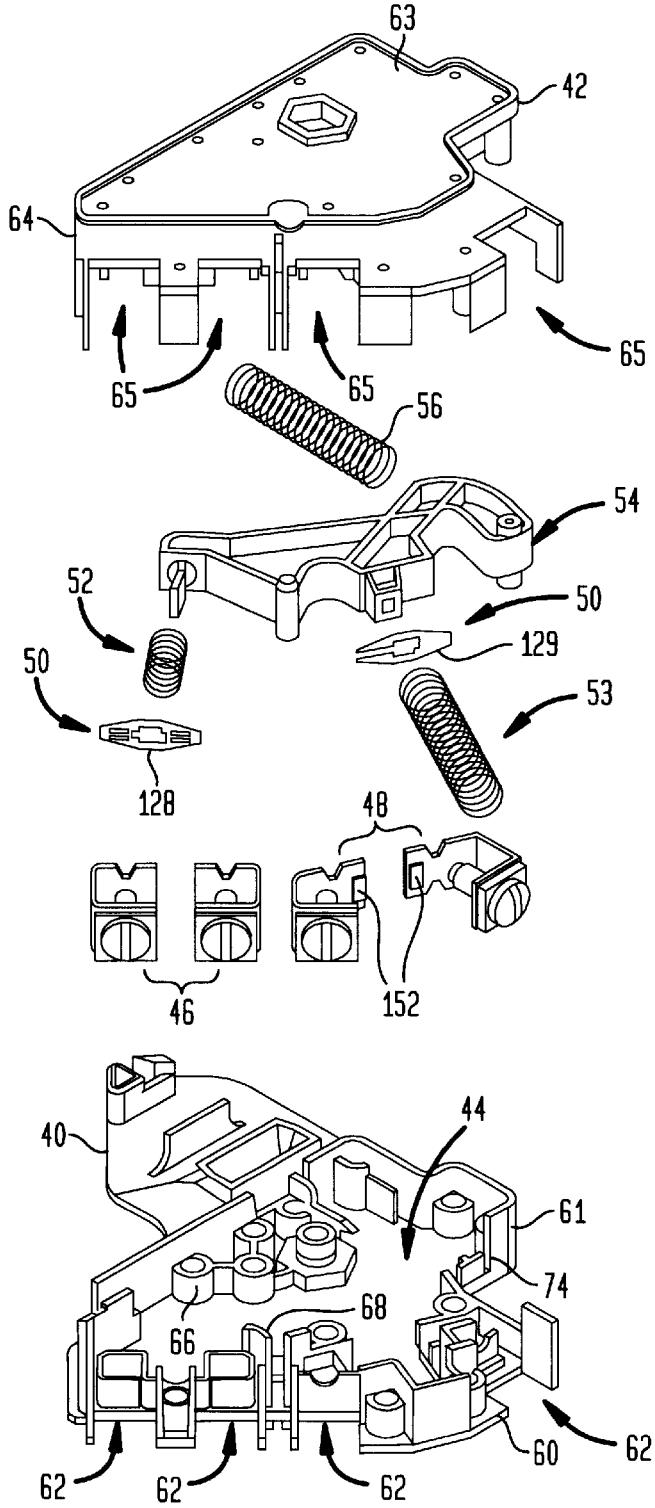
FIG. 2 is an exploded view of the contact assembly of FIG. 1.
Figure 3:
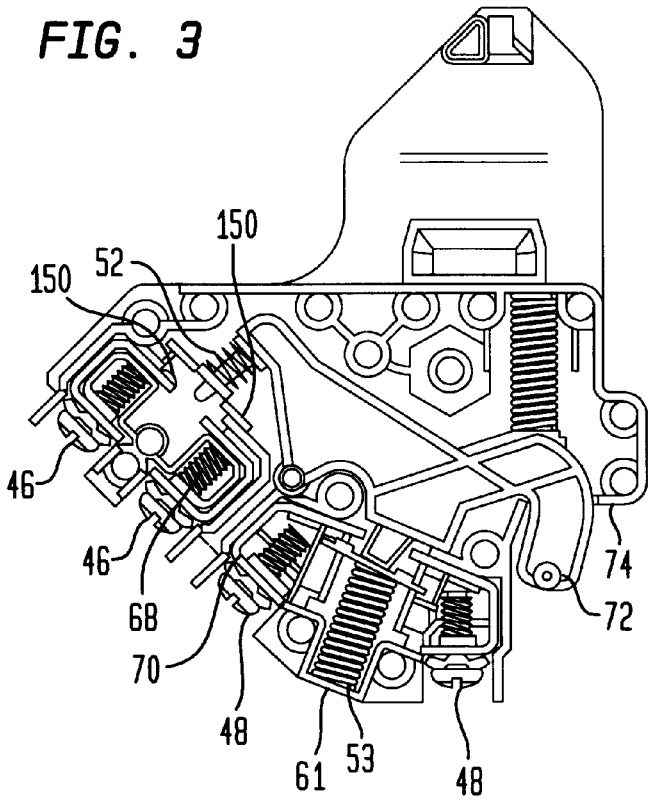
FIG. 3 is a plan view of the contact assembly of FIG. 2 with a cover removed.
Figure 4:
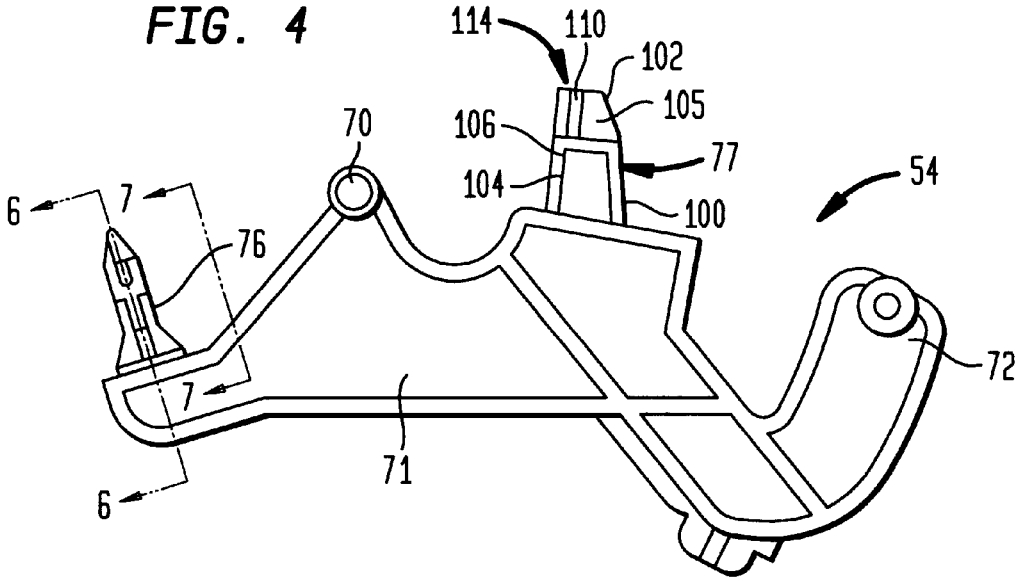
FIG. 4 is a side elevation view of a pusher of the contact assembly of FIG. 2.
Figure 5:
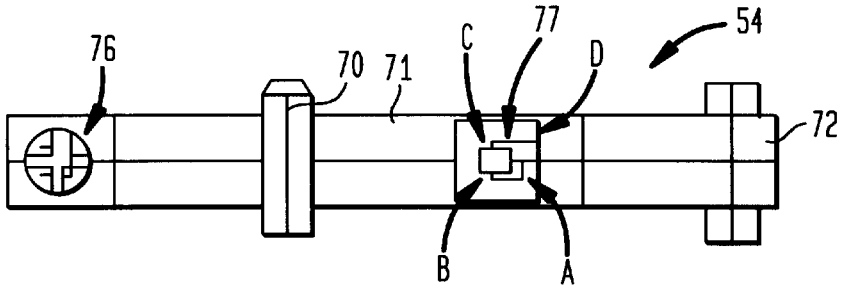
FIG. 5 is a top plan view of the pusher of FIG. 4.
Figure 6:
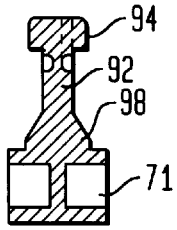
FIG. 6 is a sectional view taken along the line 6—6 of FIG. 4.
Figure 7:
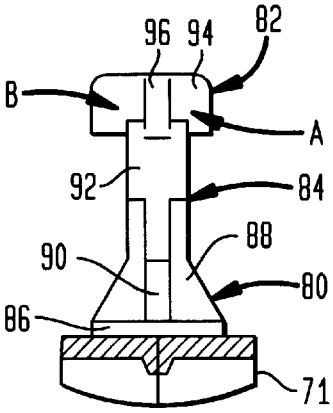
FIG. 7 is a cutaway sectional view taken along the line 7—7 of FIG. 4.
Figure 8:
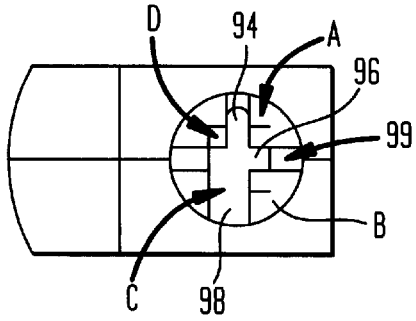
FIG. 8 is a detailed cutaway top plan view of a post on the pusher of FIG. 4.

Referring to FIGS. 2 and 3, the auxiliary contact block 20 includes a housing 40 and a cover 42 to define an interior space 44. Both the housing 40 and cover 42 are of one-piece molded plastic. Mounted in the interior space 44 are a first pair of stationary normally open contacts 46, a second pair of stationary normally open contacts 48, two movable contacts 50, a first contact spring 52, a second contact spring 53, a pusher 54 and a return spring 56.

The housing 40 includes a generally planar outer wall 60 connected to an upwardly turned side wall 61. The side wall 61 extends generally around the perimeter of the outer wall 60 except for terminal openings 62. The cover 42 includes a generally planar outer wall 63 connected to a downwardly turned partial side wall 64. The side wall 64 extends generally around a portion of the perimeter of the outer wall 63 and provides terminal openings 65. Particularly, the cover outer wall 63 is virtually a mirror image of the housing outer wall 60. The cover side wall 64 and housing side wall 61 provide a perimeter wall around the interior space 44 with the openings 62 and 65 in the same positions to provide external access to the stationary contacts 46 and 48. A plurality of collars 66 extend upwardly from the housing outer wall 60. The collars 66 receive posts (not shown) extending downwardly from the cover outer wall 63 to retain the cover 42 on the housing 40.

An annular ring 68 on the housing outer wall 60, and a similar annular ring (not shown) on the cover outer wall 63, receive a pivot post 70 of the pusher 54 to pivotally mount the pusher 54 in the interior space 44. The pusher 54 is of one piece molded plastic and includes an elongate base 71 that includes an arm 72 at one end that extends outwardly of an opening 74 in the housing side wall 61, as particularly illustrated in FIG. 3. The pusher 54 also includes a first post 76 and a second post 77 extending upwardly from the base 71 on opposite sides of the pivot post 70. The first post 76 is adapted to support the contact spring 52 and one of the movable contacts 50, as described below. The second post 76 is adapted to support the other one of the movable contacts 50 which is held in place by the second contact spring 53. Particularly, the second contact spring 53 is compressed between the side wall 61 and the moveable contact 50 so that it pushes the moveable contact 50 onto the second post 77.

The stationary contacts 46 and 48 are mounted in the housing 40 as illustrated in FIG. 3. With the pusher 54 pivotally mounted in the housing 40, each of the movable contacts 50 is positioned in proximity to one of the stationary contact pairs 46 or 48. In the illustrated embodiment of the invention, both of the movable contacts 50 provides a normally open contact arrangement relative to the stationary contacts 46 and 48. Other contact relationships may also be used. The return spring 56 biases the pusher 54 into a normal position. The stationary contacts 46 and 48, the second contact spring 53, the pusher 54 and the return spring 56 are loosely held in the interior space 44 captured between the cover 42 and the housing 40.

In operation, depressing the pusher arm 72 against the return spring 56 causes the state of the movable contacts 50 relative to the contact pairs 46 or 48 to change from open to close. Releasing the arm 72 causes the pusher 54 to return to the normal position under the force of the return spring 56. The contact springs 52 and 53 maintain a bias on the movable contacts 50 so they selectively maintain desired contact with the stationary contacts 46 or 48.

The housing 40, cover 42, movable contacts 50, stationary contacts 46 and 48 and contact springs 52 and 53 can be used to create a variety of switching arrangements with different make and break configurations and timing by varying the geometry of the pusher 54 and the point about which the pusher 54 pivots.

Referring to FIGS. 4–8, the first post 76 has a first end 80 connected to a second end 82 via a connecting portion 84. The first end 80 is connected to the base 71. The first end 80 includes a planar plate 86 on the base 71. First and second intersecting planar legs 88 and 90 extend upwardly from the plate 86. A square block 92 is connected atop the legs 88 and 90. The legs are wider proximate the plate 86, to define the first end 88, and narrow at the connecting portion 84 to a width corresponding to width of the block 92. The second end 82 comprises first and second intersecting cross members 94 and 96 atop the block 92. The first cross member 94, which extends transversely relative to the base 71, is longer than the second cross member 96, which extends longitudinally relative to the base 71. The cross members 94 and 96 define four quadrants A, B, C and D. A body 98 of plastic material extends between the cross members 94 and 96 in the third quadrant C to define a head 99. The body 98 causes the head 99 to be asymmetrical.

The second post 77 has a first end 100 connected to a second end 102. The first end 100 is connected to the base 71. The first end 100 includes an inverted U-shaped leg 104 on the base 71 to define a support 106. The second end 102 comprises first and second intersecting cross members 108 and 110 atop the support 106. The first cross member 108, which extends longitudinally relative to the base 71, is longer than the second cross member 110, which extends transversely relative to the base 71. The cross members 108 and 110 define four quadrants A, B, C and D. A body 112 of plastic material extends between the cross members 108 and 110 in the fourth quadrant D to define a head 114. The body 112 causes the head 114 to be asymmetrical.

Figure 9:
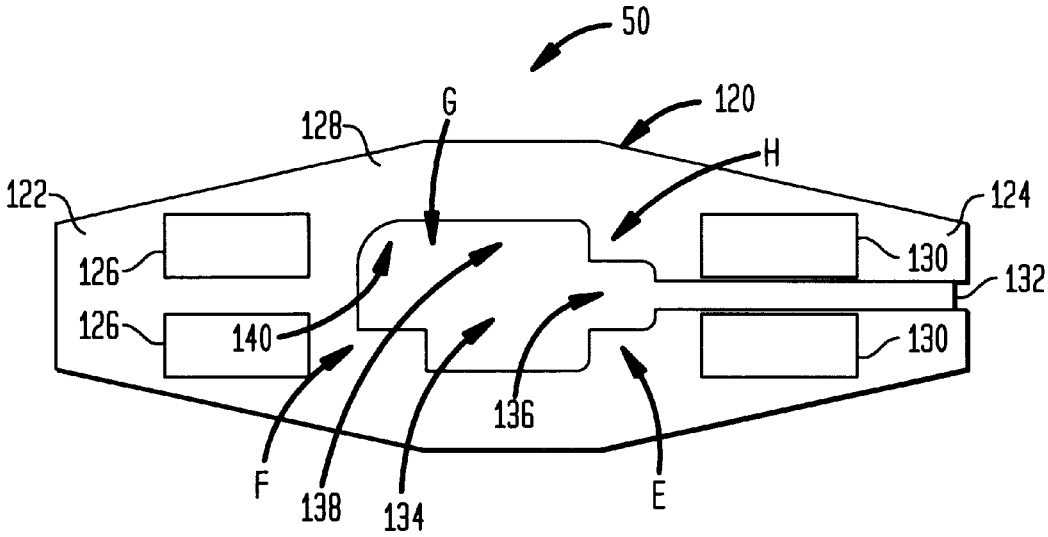
FIG. 9 is a plan view of a moveable contact of the contact assembly of FIG. 2.

Referring to FIG. 9, the moveable contact 50 is illustrated. The movable contact 50 includes an elongate contact bar 120 having opposite ends 122 and 124. A pair of contact pads 126 are on a top face 128 of the bar 120 at the first end 122. A pair of contact pads 130 are on the top face of the bar 120 at the second end 124. There are no contact pads on a bottom face 129, see FIG. 2. The contact bar 120 is in the form of a flattened octagon and is made of a resilient, electrically conductive material such as copper or brass. The second end 124 is bifurcated at 132.

The contact bar 120 includes an asymmetrical central through opening 134. The opening 134 comprises intersecting rectangular slots 136 and 138 defining four quadrants E, F, G and H. A void 140, forming part of the central opening 134, extends between the slots 136 and 138 in the third quadrant G. The through opening 134 is of a similar shape as, albeit slightly larger than, the first post head 99. Similarly, the through opening 134, if the bar 120 is turned upside down, is of a similar shape as, albeit slightly larger than, the second post head 114.

As described, the asymmetrical post heads 99 and 114 and the asymmetrical opening 134 prevent the movable contact from being installed upside-down relative to a desired direction.

While the moveable contact opening slots and post cross members are generally rectangular, other shapes could be used, as will be appreciated by those skilled in the art.

Figure 10:
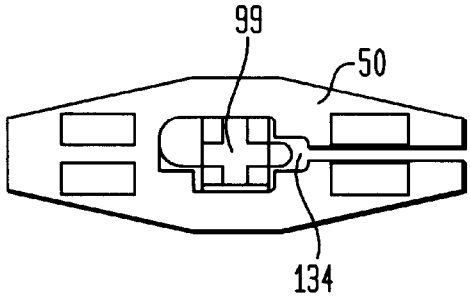
FIG. 10 is a generalized view illustrating correct assembly of the moveable contact of FIG. 9 on the post of FIG. 8.

The moveable contact 50 is to be mounted on the first post 76 with the top face 128 facing away from the base 71, as shown in FIG. 2. This insures that the contact pads 126 and 130 will make electrical contact with contact pads 150 of the first pair of stationary contacts 46, see FIG. 3. To be installed properly, post quadrants A, B, C and D, see FIG. 8, must be oriented with opening quadrants E, F, G and H, see FIG. 9, respectively. This relationship is illustrated in FIG. 10. After the contact spring 52 is mounted on the first post, the moveable contact 50 is aligned transversely relative to the base 71 above the first post 76, as generally illustrated in FIG. 10, with the central opening 134 receiving the head 99. The contact bar 120 is moved down until the first post connecting portion 84 is received in the through opening 134. The contact bar is rotated ninety degrees and released. Thereafter, the contact spring 52 forces the contact bar 120 against the head 99 and the longer cross member 94 acts as a fulcrum for the contact bar 120.

Figure 11:
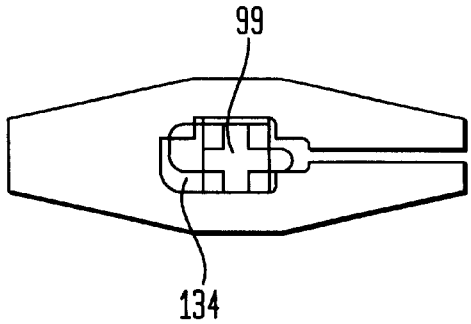
FIG. 11 is a generalized view, similar to FIG. 10, illustrating incorrect assembly of the moveable contact of FIG. 9 on the post of FIG. 8.

If the contact bar 120 is turned upside down, as shown in FIG. 11, then the first post asymmetrical head 99 does not fit in the contact bar asymmetrical central opening 134 to thereby prevent incorrect assembly.

The moveable contact 50 is to be mounted on the second post 77 with the top face 128 facing the base 71, as shown in FIG. 2. This insures that the contact pads 126 and 130 will make electrical contact with contact pads 152 of the second pair of stationary contacts 48, see FIG. 2. To be installed properly, post quadrants A, B, C and D, see FIG. 5, must be oriented with opening quadrants F, E, H and G, see FIG. 9, respectively. The moveable contact 50 is aligned longitudinally relative to the base 71 above the second post 77. The contact bar 120 is moved down with the central opening 134 receiving the head 114 until the contact bar 120 rests on the support 106. Thereafter, when the pusher 54 is mounted in the housing 40, the second contact spring 53 forces the contact bar 120 against the support 106. Again, if the contact bar 120 is turned upside down then the second post asymmetrical head 114 would not fit in the contact bar asymmetrical central opening 134 to thereby prevent incorrect assembly It can therefore be appreciated that a new and novel system and method for mounting a moveable contact in a contact block has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

We claim:

1. A contact assembly for use in an electrical apparatus comprising:

an armature comprising a base, a post having first and second ends, the first end being connected to the base and the second end comprising intersecting cross members defining four quadrants and a body extending between the cross members in one of the four quadrants; and a moveable contact received on the post, the moveable contact comprising an elongate bar having contact pads at opposite ends of one face and a central opening, the central opening comprising intersecting slots defining four quadrants and a void extending between the slots in one of the four quadrants, the central opening being slightly larger than the post second end so that the moveable contact is mounted to the post with the contact pads facing in a desired direction.

2. The contact assembly of claim 1 wherein one of the slots has a greater length than the other of the slots and one of the cross members has a greater length than the other of the cross members.

3. The contact assembly of claim 2 wherein the slot having the greater length extends longitudinally and the other of the slots extends transversely.

4. The contact assembly of claim 3 wherein the base comprises an elongate base and the cross member having the greater length extends longitudinally relative to the elongate base.

5. The contact assembly of claim 4 wherein the post includes a support below the second end to support the moveable contact longitudinally extending relative to the elongate base.

6. The contact assembly of claim 3 wherein the base comprises an elongate base and the cross member having the greater length extends transversely relative to the elongate base.

7. The contact assembly of claim 4 wherein the post has a narrower section between the first and second ends and the moveable contact is mounted on the narrower section and extends longitudinally relative to the elongate base and the cross member having the greater length acts as a fulcrum for the moveable contact.

8. A contact assembly for use in an electrical apparatus comprising:

an armature comprising a base, a post having first and second ends, the first end being connected to the base and the second end having an asymmetric head; and a moveable contact received on the post, the moveable contact comprising an elongate bar having contact pads at opposite ends of one face and a central opening, the central opening being asymmetric, similar in shape to the asymmetric head, the central opening being slightly larger than the asymmetric body so that the moveable contact is mounted to the post with the contact pads facing in a desired direction.

9. The contact assembly of claim 8 wherein the asymmetric head is in the shape of a cross with a body extending in one quadrant defined by legs of the cross.

10. The contact assembly of claim 9 wherein the cross is defined by intersecting cross members and the moveable contact central opening comprises intersecting slots defining four quadrants and a void extending between the slots in one of the four quadrants, the central opening being slightly larger than the post second end so that the moveable contact is mounted to the post with the contact pads facing in a desired direction.

11. The contact assembly of claim 10 wherein one of the slots extends longitudinally and has a greater length than the other of the slots which extends transversely, and one of the cross members has a greater length than the other of the cross members.

12. The contact assembly of claim 11 wherein the base comprises an elongate base and the cross member having the greater length extends longitudinally relative to the elongate base and wherein the post includes a support below the second end to support the moveable contact longitudinally extending relative to the elongate base.

13. The contact assembly of claim 11 wherein the base comprises an elongate base and the cross member having the greater length extends transversely relative to the elongate base.

14. The contact assembly of claim 13 wherein the post has a narrower section between the first and second ends and the moveable contact is mounted on the narrower section and extends longitudinally relative to the elongate base and the cross member having the greater length acts as a fulcrum for the moveable contact.

15. The method of mounting a moveable contact in a contact block comprising:

providing an armature comprising a base, a post having first and second ends, the first end being connected to the base and the second end comprising intersecting cross members defining four quadrants and a body extending between the cross members in one of the four quadrants;

mounting a moveable contact on the post, the moveable contact comprising an elongate bar having contact pads at opposite ends of one face and a central opening, the central opening comprising intersecting slots defining four quadrants and a void extending between the slots in one of the four quadrants, the central opening being slightly larger than the post second end so that the moveable contact is mounted to the post with the contact pads facing in a desired direction; and mounting the armature in a housing.

16. The method of claim 15 wherein the moveable contact is provided with one of the slots having a greater length than the other of the slots and the armature is provided with one of the cross members having a greater length than the other of the cross members.

17. The method of claim 16 wherein the slot having the greater length extends longitudinally and the other of the slots extends transversely.

18. The method of claim 17 wherein the base comprises an elongate base and the cross member having the greater length extends longitudinally relative to the elongate base.

19. The method of claim 18 wherein the post includes a support below the second end to support the moveable contact longitudinally extending relative to the elongate base.

20. The method of claim 17 wherein the base comprises an elongate base and the cross member having the greater length extends transversely relative to the elongate base.

21. The method of claim 18 wherein the post has a narrower section between the first and second ends and the moveable contact is mounted on the narrower section and extends longitudinally relative to the elongate base and the cross member having the greater length acts as a fulcrum for the moveable contact.

* * * * *